US007808456B2

(12) United States Patent
Chen et al.

(10) Patent No.: US 7,808,456 B2
(45) Date of Patent: Oct. 5, 2010

(54) DRIVING SYSTEM AND METHOD FOR AN ELECTROLUMINESCENT DISPLAY

(75) Inventors: Chien-Chung Chen, Hsinchu (TW); Hsan-Fong Lin, Judung Township, Hsinchu County (TW); Shei-Chie Yang, Wur Township, Taichung County (TW)

(73) Assignee: Ricktek Technology Corp., Hsinchu (TW)

( * ) Notice: Subject to any disclaimer, the term of this patent is extended or adjusted under 35 U.S.C. 154(b) by 835 days.

(21) Appl. No.: 11/510,816

(22) Filed: Aug. 28, 2006

(65) Prior Publication Data

US 2007/0052366 A1 Mar. 8, 2007

(30) Foreign Application Priority Data

Sep. 2, 2005 (TW) ..... 94130146 A

(51) Int. Cl.
*G09G 3/10* (2006.01)

(52) U.S. Cl. ..... 345/76; 315/169.3; 315/169.2

(58) Field of Classification Search ..... 315/169.3; 345/76–83, 176, 214
See application file for complete search history.

(56) References Cited

U.S. PATENT DOCUMENTS

| | | | | |
|---|---|---|---|---|
| 5,844,368 | A * | 12/1998 | Okuda et al. | 315/169.3 |
| 6,201,520 | B1 * | 3/2001 | Iketsu et al. | 345/76 |
| 6,339,415 | B2 * | 1/2002 | Ishizuka | 345/76 |
| 6,351,255 | B1 * | 2/2002 | Ishizuka et al. | 345/77 |
| 6,473,064 | B1 * | 10/2002 | Tsuchida et al. | 345/82 |
| 6,486,607 | B1 * | 11/2002 | Yeuan | 315/169.1 |
| 6,501,226 | B2 * | 12/2002 | Lai et al. | 315/169.1 |
| 6,914,388 | B2 * | 7/2005 | Shin et al. | 315/169.2 |

* cited by examiner

*Primary Examiner*—Bipin Shalwala
*Assistant Examiner*—Kelly Hegarty
(74) *Attorney, Agent, or Firm*—Rosenberg, Klein & Lee

(57) ABSTRACT

A driving system and method for electroluminescent displays which by connecting the electroluminescent elements that have been lighted up to the electroluminescent elements that are to be lighted up causes charge to be shared among the elements, so as to increase the voltage level at the anodes of the electroluminescent elements which are to be lighted up, thereby reducing the power consumption and increasing the response speed.

4 Claims, 4 Drawing Sheets

DRIVING SYSTEM AND METHOD FOR AN ELECTROLUMINESCENT DISPLAY

FIELD OF THE INVENTION

The present invention is related generally to an electroluminescent display and, more particularly, to a driving system and method for an electroluminescent display.

BACKGROUND OF THE INVENTION

A typical electroluminescent display comprises an array of electroluminescent elements arranged in rows and columns in which the anodes of the electroluminescent elements on each row are electrically connected to one of a plurality of anode lines and the cathodes of the electroluminescent elements on each column are electrically connected to one of a plurality of cathode lines, and a driving system to switch the anode lines and the cathode lines between two phases according to display data for specifically lighting up one or ones of the electroluminescent elements.

To speed up the electroluminescent elements in an electroluminescent display to light up, the driving system disclosed by U.S. Pat. No. 5,844,368 to Okuda et al. precharges the electroluminescent element that is to be lighted up. In this driving scheme, however, all the anodes and cathodes of the electroluminescent elements are grounded for the electric charges thereon to be completely discharged before an electroluminescent element is lighted up and as a result, each time the electroluminescent element is charged from 0 V when it is to be lighted up, which requires greater power consumption. Furthermore, the current supplied to the electroluminescent elements by the current source of the driving system is so small that the electroluminescent display slowly responds to the driving control.

On the other hand, the driving system proposed by U.S. Pat. No. 6,501,226 to Lai et al. comprises switches each of which is inserted between two adjoining cathode lines of the electroluminescent element array, and turns on the corresponding one or ones of the switches between the cathode line being scanned and the next cathode line to be scanned to equalize the electric charges in the electroluminescent elements on the currently scanned cathode line and on the next cathode line to be scanned, so as to reduce the power demand of lighting up the electroluminescent elements.

There is still a need of reduced power demand and enhanced performance in response speed for an electroluminescent display.

SUMMARY OF THE INVENTION

An object of the present invention is to provide a driving system and method for an electroluminescent display to attain less power demand and faster response.

In an electroluminescent display having a driving system to drive an array of electroluminescent elements according to a display data, the anodes of the electroluminescent elements on the same column are electrically connected to one of a plurality of anode lines, and the cathodes of the electroluminescent elements on the same row are electrically connected to one of a plurality of cathode lines. In the driving system, according to the present invention, a row and column control circuit generates two control signals from the display data, an anode line driving circuit in response to the first control signal switches each of the anode lines among connections of a current source, a first node and ground, and a cathode line scanning circuit in response to the second control signal switches each of the cathode lines among connections of a reverse voltage, a second node and ground, wherein the first and second nodes are electrically connected together. When one or more of the electroluminescent elements are to be lighted up, the anode lines connected to their anodes and the anode lines connected to the electroluminescent elements currently being canned are switched to connect to the respective first nodes, and the cathode lines connected to their cathodes and the cathode lines connected to the electroluminescent elements currently being canned are switched to connect to the respective second nodes, such that part of the electric charges in the electroluminescent elements currently being lighted up are recycled and transferred to the electroluminescent elements to be lighted up. Therefore, the power demand to light up the electroluminescent elements is reduced. Further, before the anode line is switched from the first node to the current source, it is switched to connect to a power source to precharge thereto, so as to enhance the response speed of lighting up the electroluminescent elements to be lighted up.

BRIEF DESCRIPTION OF DRAWINGS

These and other objects, features and advantages of the present invention will become apparent to those skilled in the art upon consideration of the following description of the preferred embodiments of the present invention taken in conjunction with the accompanying drawings, in which.

DETAIL DESCRIPTION OF THE INVENTION

Figure 1:
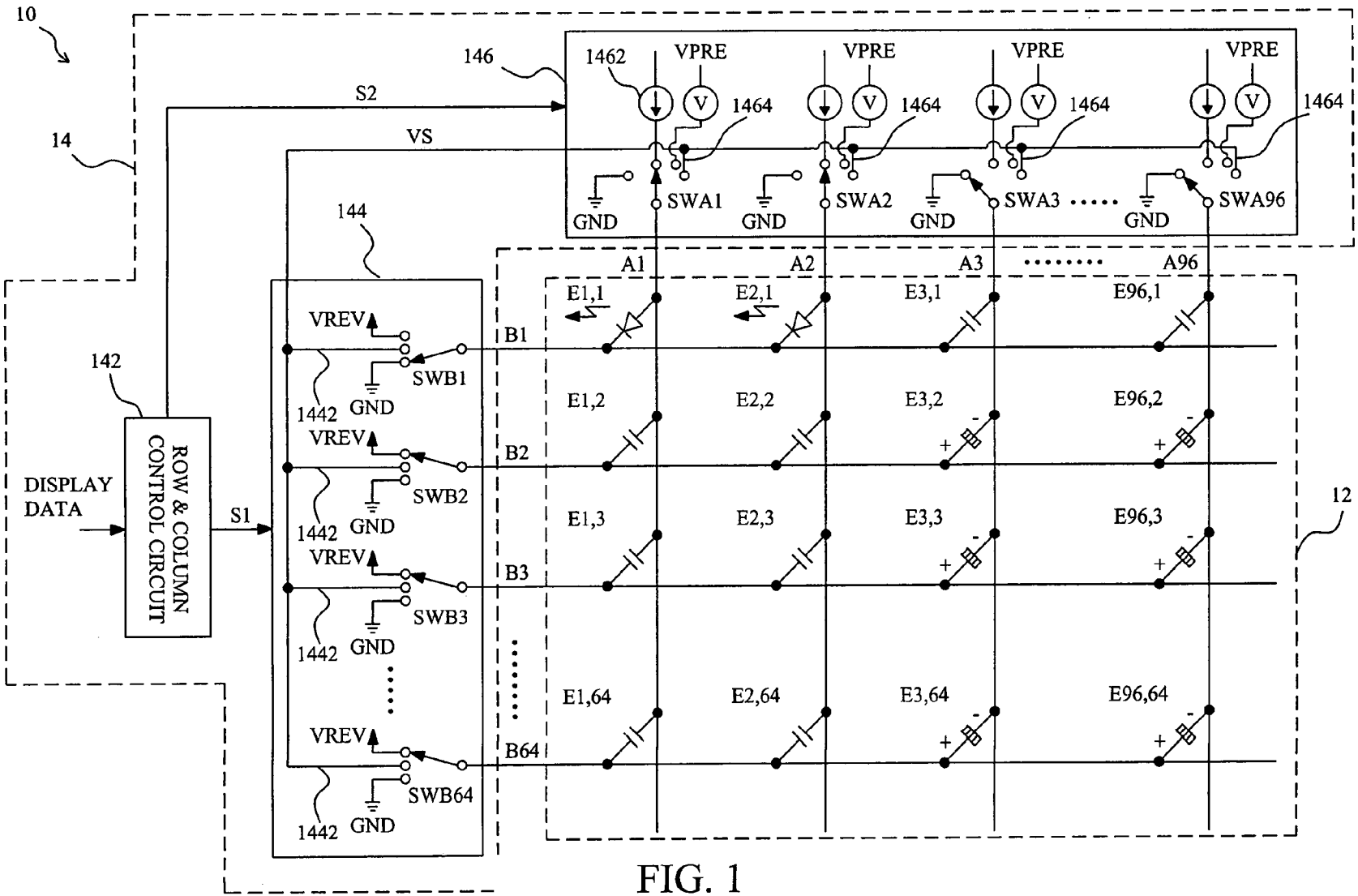
FIG. 1 shows an electroluminescent display according to the present invention.

FIG. 1 schematically depicts an electroluminescent display 10, which comprises an array 12 of organic electroluminescent elements Ex,y (x=1, 2, . . . , 96; y=1, 2, . . . , 64) and a driving system 14 connected to the organic electroluminescent elements Ex,y with a plurality of drive lines Ax (x=1, 2, . . . , 96) and a plurality of scan lines By (y=1, 2, . . . , 64). In the array 12, the organic electroluminescent elements Ex,y are arranged in such a manner that the anodes of the organic electroluminescent elements Ei,y on the i-th column are connected to the i-th anode line Ai, and the cathodes of the organic electroluminescent elements Ex,j on the j-th row are connected to the j-th cathode line Bj. In the driving system 14, a row and column control circuit 142 generates two control signals S1 and S2 according to a display data for a cathode line scanning circuit 144 and an anode line driving circuit 146, respectively, such that each of the cathode lines B1-B64 is switched among connections of a power source supplying a reverse voltage VREV, a node 1442 for providing a virtual voltage VS, and ground GND by the cathode line scanning circuit 144, and each of the anode lines A1-A96 is switched among connections of a current source 1462, a power source supplying a precharge voltage VPRE, a node 1464 for providing a virtual voltage VS, and ground GND by the anode line driving circuit 146. The nodes 1442 and 1464 for providing the virtual voltages VS for the anode lines A1-A96 and the cathode lines B1-B64 are connected together. As exemplary shown in FIG. 1, the cathode line B1 is grounded, the rest of the cathode lines B2-B64 are all connected to the reverse voltage VREV, two anode lines A1 and A2 are connected to the respective current sources 1462, the rest of the anode lines A3-A96 are grounded, and thus in the array 12, only the organic electroluminescent elements E1,1 and E2,1 are lighted up.

Figure 2:
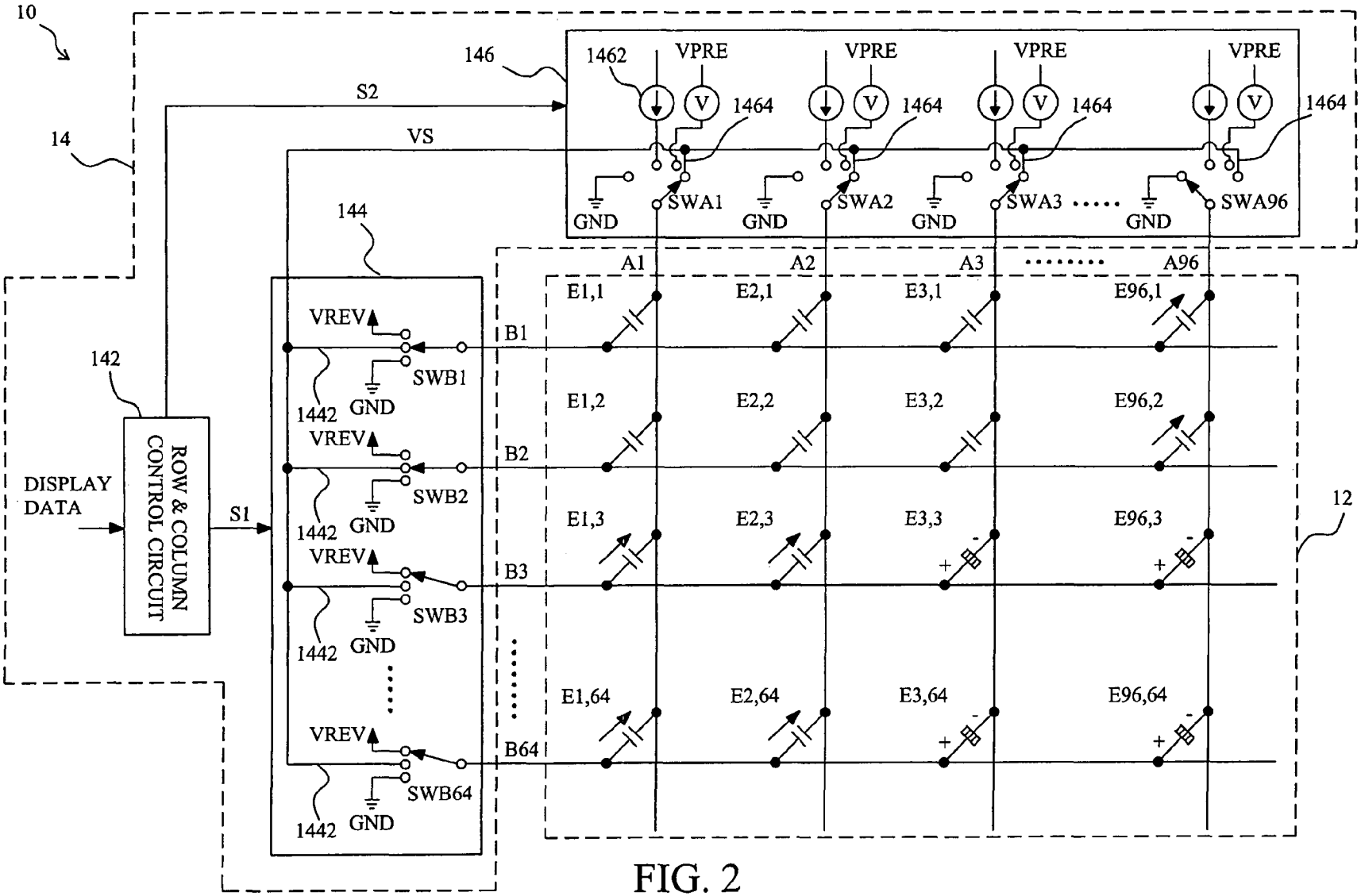
FIG. 2 shows the electroluminescent display of FIG. 1 in a first phase of operation.
Figure 3:
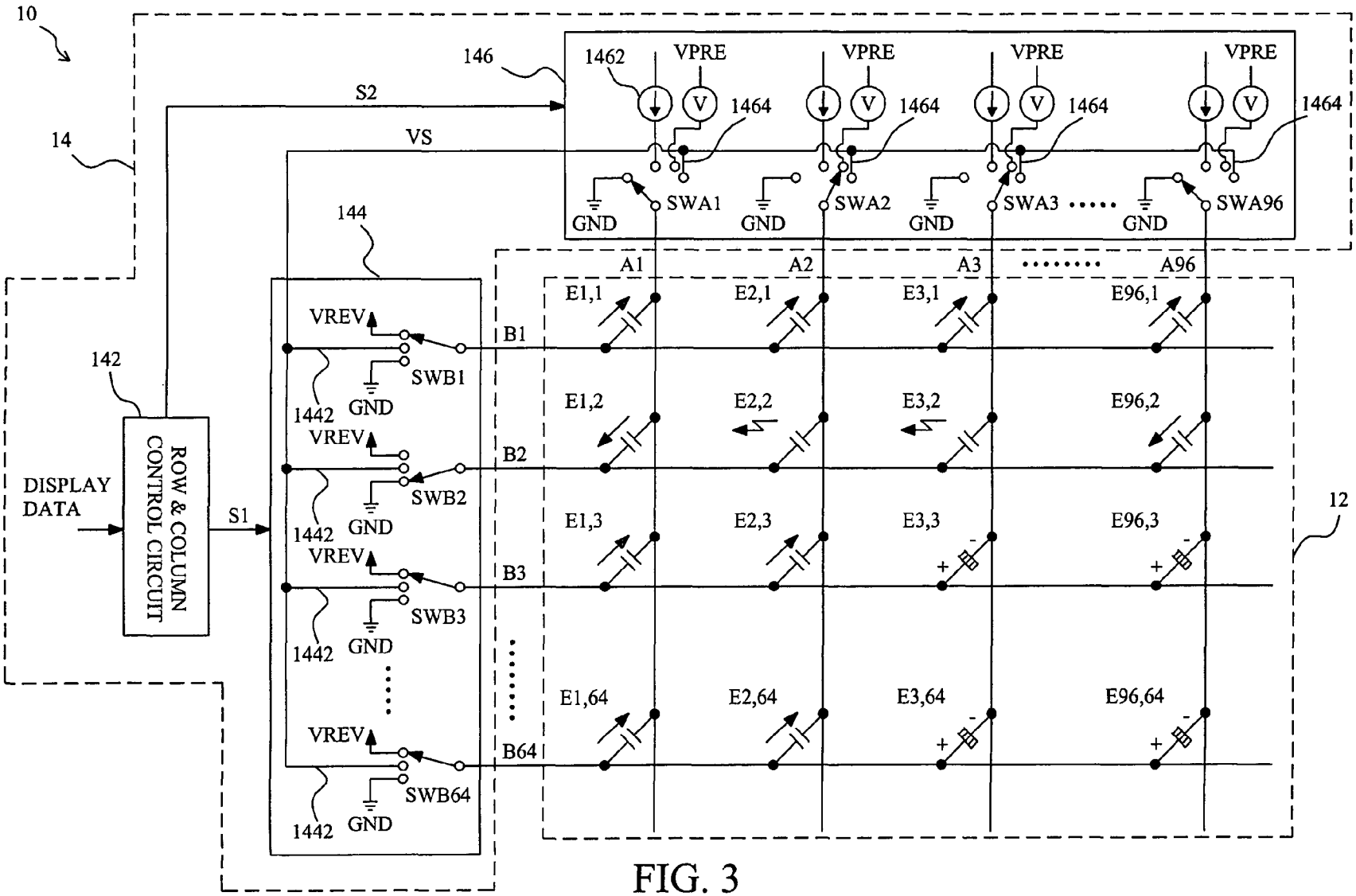
FIG. 3 shows the electroluminescent display of FIG. 1 in a second phase of operation.
Figure 4:
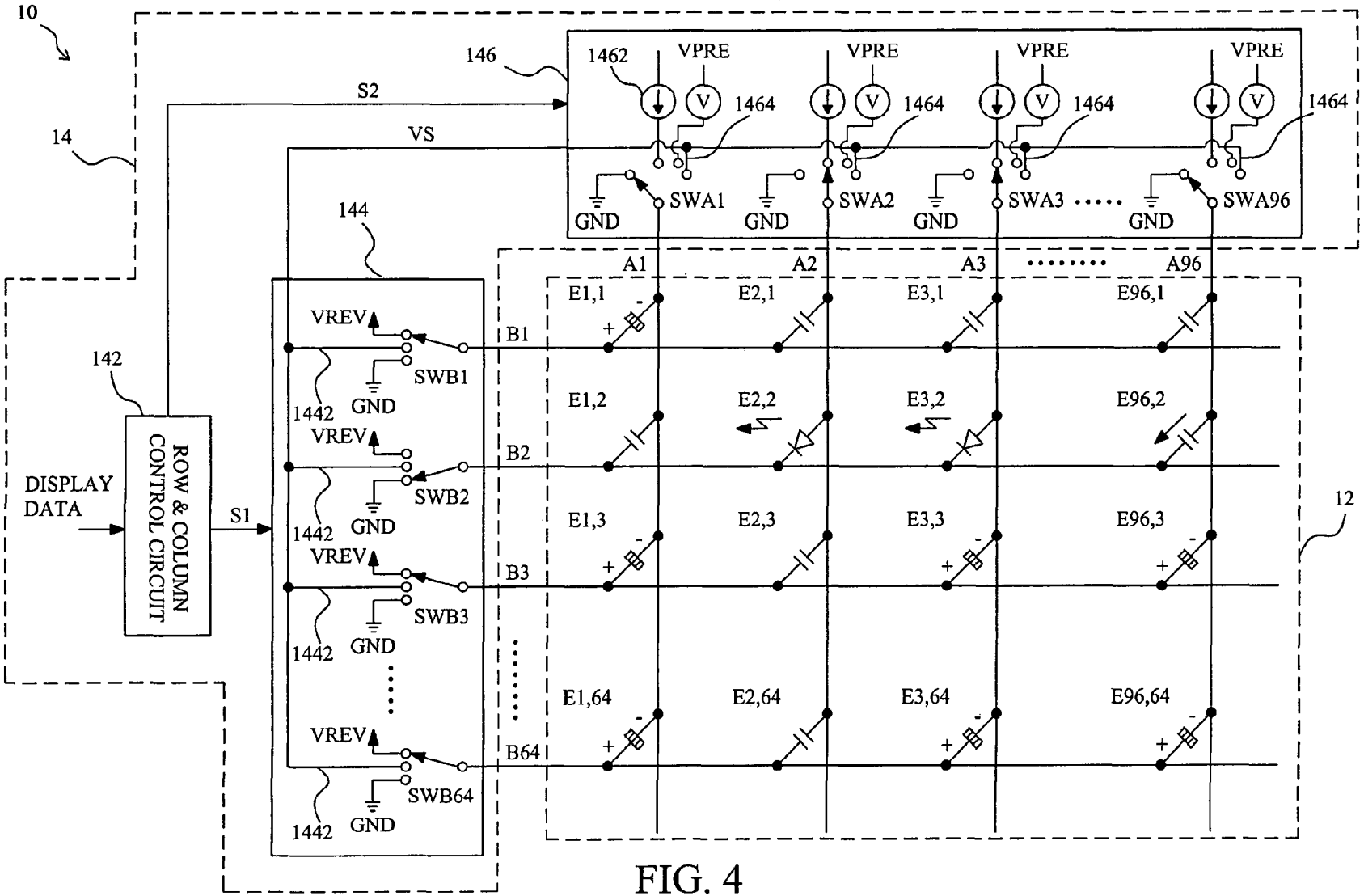
FIG. 4 shows the electroluminescent display of FIG. 1 in a third phase of operation.

FIGS. 2-4 show how the driving system 14 operates when the organic electroluminescent elements E2,2 and E3,2 are to be lighted up from the state shown in FIG. 1. In the first step, as shown in FIG. 2, the cathode lines B1 and B2 connected with the organic electroluminescent elements E1,1, E2,1, E2,2 and E3,2 are switched by the cathode line scanning circuit 144 to connect to the respective nodes 1442, and the anode lines A1, A2 and A3 connected with the organic electroluminescent elements E1,1, E2,1, E2,2 and E3,2 are switched by the anode line driving circuit 146 to connect to the respective nodes 1464. Since the nodes 1442 and 1464 are connected together, the charges in the organic electroluminescent elements E1,1, E2,1, E3,1, E1,2, E2,2 and E3,2 are shared among those elements, which equalizes the voltages of the organic electroluminescent elements E1,1, E2,1, E3,1, E1,2, E2,2 and E3,2, and consequently builds up a virtual voltage VS on the nodes 1442 and 1464. In this step, part of the electric charges in the currently lighted organic electroluminescent elements E1,1 and E2,1 are transferred to the organic electroluminescent elements E2,2 and E3,2 to be lighted up, so that the electric charges can be recycled to save energy. In the phase shown in FIG. 2, the voltages on the active anode lines A1, A2 and A3 and on the cathode lines B1 and B2 become the virtual voltage VS, while the voltages on the inactive anode lines remains at the ground level and the voltages on the inactive cathode lines remains at the reverse voltage VREV.

In the next step, as shown in FIG. 3, the anode lines A2 and A3 connected with the organic electroluminescent elements E2,2 and E3,2 to be lighted up are switched by the anode line driving circuit 146 to connect to the respective precharge voltages VPRE, the cathode line B2 connected with the organic electroluminescent elements E2,2 and E3,2 to be lighted up is switched by the cathode line scanning circuit 144 to ground GND, and the rest of the anode lines Ai's and the cathode lines Bj's are switched to ground GND and the reverse voltage VREV, respectively. In this step, the organic electroluminescent elements E2,2 and E3,2 to be lighted up are precharged by the power sources VPRE so as to speed up their response. In the operation shown in FIG. 3, the voltages on the active anode lines A2 and A3 become the precharge voltage VPRE, the voltage on the active cathode line B2 become the ground level, the voltages on the inactive anode lines remains at the ground level, and the voltages on the inactive cathode lines remains at the reverse voltage VREV.

As shown in FIG. 4, after the anodes of the organic electroluminescent elements E2,2 and E3,2 are precharged to the precharge voltage VPRE, the anode lines A2 and A3 of the organic electroluminescent elements E2,2 and E3,2 are switched by the anode line driving circuit 146 to connect to the respective current sources 1462 to light up the organic electroluminescent elements E2,2 and E3,2. In the operation shown in FIG. 4, the voltages on the active anode lines A2 and A3 remain at the precharge voltage VPRE, the organic electroluminescent elements E2,2 and E3,2 are lighted up, the voltages on the active cathode line B2 remains at the ground level, the voltages on the inactive anode lines remain at the ground level, and the voltages on the inactive cathode lines remain at the reverse voltage VREV.

In the process of lighting up the electroluminescent elements, by switching the anode lines and the cathode lines among the three phases of operation, the electric charges in the electroluminescent elements which have been lighted up are recycled and transferred to the electroluminescent elements to be lighted up, thus reducing the power demand, and the subsequent precharging step further improve the response speed thereof.

While the present invention has been described in conjunction with preferred embodiments thereof, it is evident that many alternatives, modifications and variations will be apparent to those skilled in the art. Accordingly, it is intended to embrace all such alternatives, modifications and variations that fall within the spirit and scope thereof as set forth in the appended claims.

What is claimed is:

1. A driving system for an electroluminescent display having an array of electroluminescent elements arranged in a plurality of rows and columns in such a manner that anodes of the electroluminescent elements arranged along one of the rows or columns are connected to a corresponding anode line, and cathodes of the electroluminescent elements arranged along another of the rows or columns are connected to a corresponding cathode line, the driving system comprising:

a row and column control circuit for generating a first control signal and a second control signal according to a display data;

an anode line driving circuit in response to the first control signal for switching each of the anode lines among connections of a current source, a first virtual voltage node, and ground; and a cathode line scanning circuit in response to the second control signal for switching each of the cathode lines among connections of a reverse voltage, a second virtual voltage node, and ground;

wherein the first virtual voltage nodes of the anode line driving circuit are directly connected to the second virtual voltage nodes of the cathode line driving circuit for combined equalization of selected anode and cathode lines.

2. The driving system of claim 1, wherein the anode line driving circuit further switches each of the anode lines to connect to a precharge voltage before switching it from the first virtual voltage node to the current source; whereby said anode line switches from the first virtual voltage node to the precharge voltage, and from the precharge voltage to the current source.

3. A driving method for an electroluminescent display having an array of electroluminescent elements arranged in a plurality of rows and columns in such a manner that anodes of the electroluminescent elements arranged along one of the rows or columns are connected to a corresponding anode line, and cathodes of the electroluminescent elements arranged along another of the rows or columns are connected to a corresponding cathode line, the method comprising the steps of:

switching the anode and cathode lines connected with the electroluminescent elements which have been lighted up and the anode and cathode lines connected with the electroluminescent element to be lighted up to electrically connect to respective first and second virtual voltage nodes, said first virtual voltage nodes of the anode lines being directly connected to the second virtual voltage nodes of the cathode lines for combined equalization of selected anode and cathode lines; and thereafter switching the anode and cathode lines connected with the electroluminescent elements which have been lighted up and connected with the electroluminescent elements to be lighted up to connect to respective power sources or ground such that the electroluminescent elements to be lighted up are supplied with respective bias currents.

4. The driving method of claim 3, further comprising the step of switching each anode line connected with any electroluminescent elements to be lighted up to connect from the first virtual voltage node to a precharge voltage before switching it to receive a respective bias current.

* * * * *